United States Patent [19]

Thuries et al.

[11] Patent Number: 4,841,788

[45] Date of Patent: Jun. 27, 1989

[54] ENERGY STORAGE DEVICE WITH ZERO LATCHING FORCE

[75] Inventors: Edmond Thuries, Pusignan; Michel Perret, Tramole; Jean-Paul Masson, Villeurbanne, all of France

[73] Assignee: Alsthom, Paris, France

[21] Appl. No.: 169,534

[22] Filed: Mar. 17, 1988

[30] Foreign Application Priority Data

Mar. 17, 1987 [FR] France ..... 87 03637

[51] Int. Cl.[4] ..... G05G 17/00

[52] U.S. Cl. ..... 74/2; 200/400

[58] Field of Search ..... 74/2; 251/74; 200/153 SC

[56] References Cited

U.S. PATENT DOCUMENTS

| | | | |
|---|---|---|---|
| 2,256,965 | 9/1941 | Sexton | 74/2 |
| 3,008,479 | 11/1961 | Mancusi, Jr. | 251/74 X |
| 3,080,582 | 3/1963 | Reffell | 74/2 X |
| 4,460,007 | 7/1984 | Pirkle | 251/74 X |

FOREIGN PATENT DOCUMENTS

| | | |
|---|---|---|
| 1588485 | 4/1970 | France . |
| 667606 | 3/1952 | United Kingdom . |

*Primary Examiner*—Allan D. Herrmann

*Attorney, Agent, or Firm*—Sughrue, Mion, Zinn, Macpeak & Seas

[57] ABSTRACT

A zero latching force energy storage device has a first rod (10) sliding along an axis X and subjected to axial thrust from a first spring (17), with the first rod (10) being fixed at a first end to latching means and being coupled at a second end to energy storage means. The latching means include a rod (18) provided with a transverse bore (19) which, when in the set position, receives a latching member (100) controlled by an electromagnet (121). The energy storage means include a second rod (20) slidable along the same axis X and subjected to axial force from a second spring (34), with the free end of the second rod facing the free end of the first rod and being coupling to the first rod (10) and for locking it when the latching member (100) is in its set position.

8 Claims, 2 Drawing Sheets

ENERGY STORAGE DEVICE WITH ZERO LATCHING FORCE

The present invention relates to a mechanical energy storage device using springs and intended, in particular, for actuating an electric circuit-breaker.

BACKGROUND OF THE INVENTION

One conventional way of mechanical actuating circuit-breakers is to make use of a compression spring. The energy required for a maneuver is then stored in the spring while in the compressed state. The spring is held in the compressed state by a latching device which may be more or less complex, and which necessarily includes a latching member which prevents a wheel or a cam from moving.

In this respect, reference may be made to French Pat. No. 1 588 485. This French Pat. No. 1 588 485 describes a spring device controlled by impulses in order to maneuver electrical apparatuses, in particular circuit-breakers or isolators, with the maneuvering time being long relative to the duration of the controlling pulse. This device comprises a spring which drives a tripping control shaft via a cable and a cam. The device is reset by means of a shaft provided with non-return means comprising, in particular, a ratchet wheel cooperating with a pawl carrying a latching wheel at its end and driving said control shaft via a step-down drive chain in a direction opposite to the tripping direction. The pulse causes the non-return means to be held back permanently, thereby allowing tripping to be completed.

The latching member and the ratchet wheel exert a mutual force between each other and this force must be overcome in order to release the wheel and allow the spring to expand. The greater the amount of energy stored in the springs, the greater the force to be overcome, and the greater the force to be overcome the greater the amount of energy required by the trigging mechanism.

Unfortunately, it is desirable to use a low-energy tripping mechanism.

It is also desirable to be able to increase the quantity of stored energy (for example by using a plurality of springs and/or by using more powerful springs), without increasing the latching force.

This aim is achieved by the device in accordance with the invention which makes it possible to store mechanical energy with a zero latching force.

SUMMARY OF THE INVENTION

The present invention provides a zero latching force energy storage device comprising a first rod sliding along an axis X and subjected to axial thrust from a first spring, said rod being fixed at a first end to latching means and being coupled at a second end to energy storage means, the latching means comprising a rod provided with a transverse bore which, in the set position, receives a latching member controlled by an electromagnet, wherein the energy storage means include a second rod slidable along the same axis X and subjected to axial force from a second spring, with the free end of the second rod facing the free end of the first rod and being connected to means for coupling it to said first rod and for locking it when the latching member is in a set position.

This device has the great advantage of being simple to implement.

BRIEF DESCRIPTION OF THE DRAWINGS

An embodiment of the invention is described by way of example with reference to the accompanying drawings, in which.

MORE DETAILED DESCRIPTION

Figure 1:
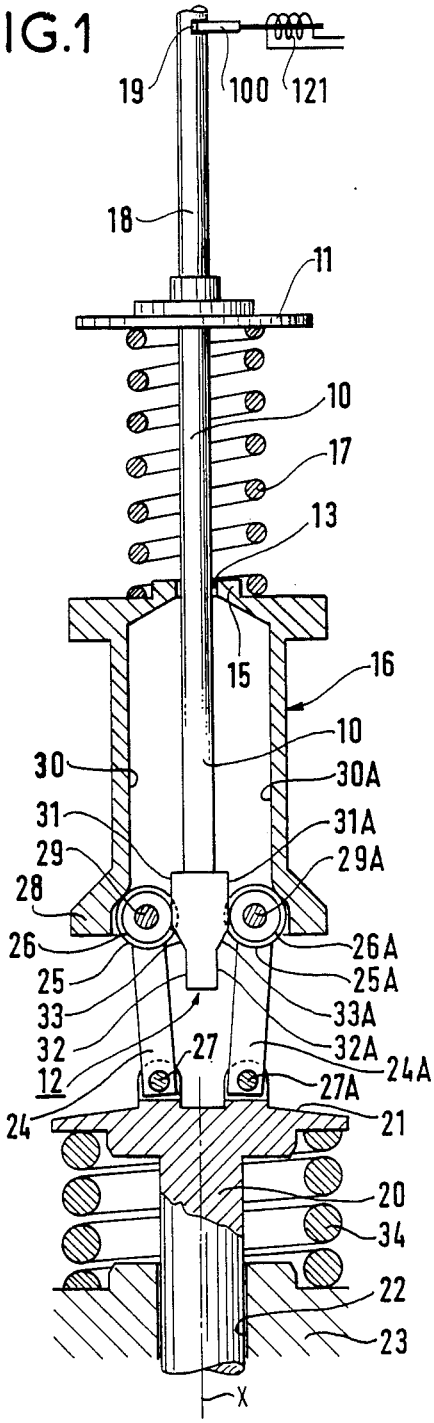
FIG. 1 is a diagrammatic view of a device in accordance with the invention and set to operate, with its spring being compressed.

FIG. 1 shows a first rod 10 provided at a first end with a collar 11 and at a second end with an end piece 12. The first rod 10 is slidably mounted along an axis X inside a bore 13 going through a cover 15 which closes the first end of a fixed cage 16: in this case the cage is square in section and its axis of symmetry is the axis X. The second end of the cage is terminated by a flared portion 28.

A first spring 17, e.g. a coil spring, is disposed around the rod 10 and is fixed at one end to the collar 11 and at its other end to the outside of the cage 16.

The first end of the rod 10 is fixed to latching means constituted, in this case, by a rod 18, e.g. a circuit-breaker control rod, provided with a transverse bore 19 into which a latching member 100 is inserted in the set position, for example by means of an electromagnet 121 which serves to hold the first rod 10 in a fixed position when the first spring 7 is compressed.

A second rod 20 is provided with a collar 21 at its first end which faces the second end of the first rod. This second rod 20 is slidably mounted along the axis X inside a bore 22 running through a fixed frame 23.

A second spring 34, e.g. a coil spring, is disposed around the rod 20 and is fixed at one end to the collar 21 and at the other end to the frame 23.

Two arms 24 and 24A are provided at their first ends with bearings 25, 26 and 25A, 26A, e.g. ball bearings, with the axes of rotation 29 and 29A of the bearings being perpendicular to the axis X. The second ends of these arms are rotatable about two axes 27 and 27A extending parallel to the axes 29 and 29A, and situated symmetrically about the axis X and fixed to the outer portion of the collar 21.

The free ends of the first and second rods 10 and 20 face one another such that the bearings 25, 26 and 25A, 26A can run between the end piece 12 and respective bearing surfaces 30 and 30A of the cage 16, with said bearing surfaces being plane, parallel, and symmetrical about the axis X. These bearing surfaces thus form two running surfaces or guiding surfaces which terminate in the flared portion 28.

As shown in FIG. 1, the end piece 12 has a plurality of symmetrical bearing surfaces about the axis X, and is in particular, it has in succession: two first plane bearing surfaces 31 and 31A which are parallel to the running surfaces 30 and 30A; two bearing surfaces 33 and 33A which are inclined towards the axis X; and two second plane bearing surfaces 32 and 32A which are parallel to the first plane bearing surfaces.

Figure 3:
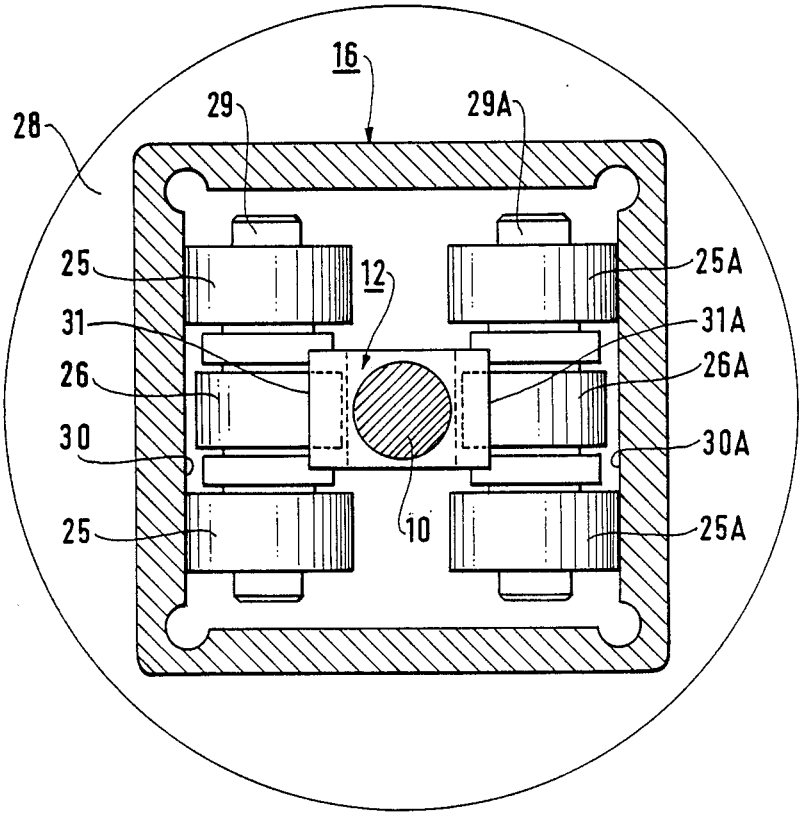
FIG. 3 is a section view of line III—III of FIG. 2.

As shown in FIG. 3, the ball bearings about each of the axes 29 and 29A are respectively constituted by pairs of first ball bearings 25 and 25A which run over the running surfaces 30 and 30A on the inside of the cage 16, with said pairs of ball bearings being disposed on either side of smaller diameter central bearings 26 or 26A which run over the outer surface of the end piece 12, i.e. over the bearing surfaces 31, 33, and 32 or 31A, 33A, and 32A.

In the set position as shown in FIG. 1, the spring 17 is compressed so that the member 100 is located in the bore 19.

Figure 2:
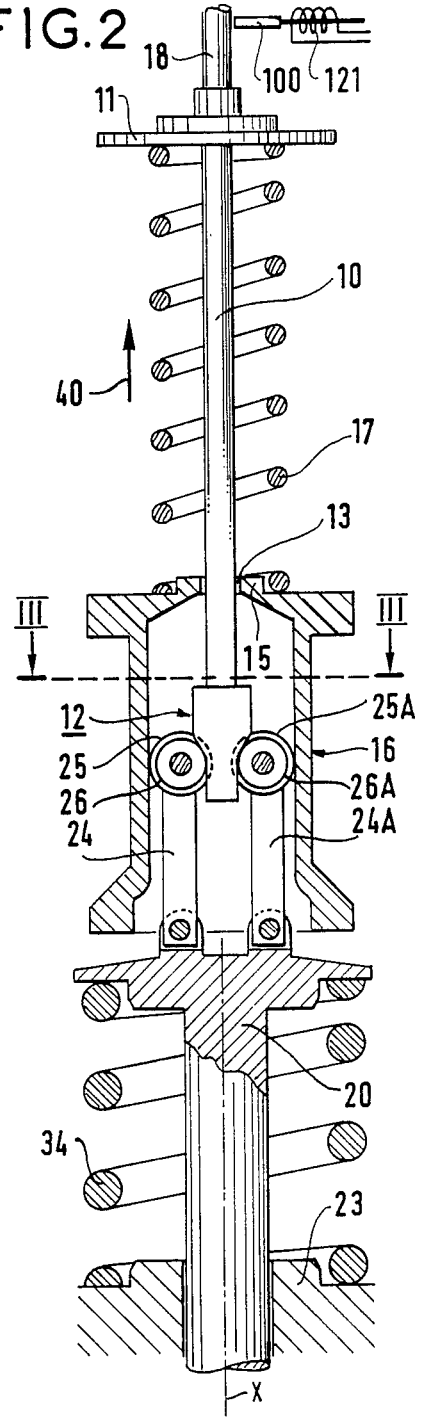
FIG. 2 is a diagrammatic view of the same device during operation.

In this position, the second spring 34 is automatically blocked: the first bearings 25 and 25A rest inside the flared portion 28 of the cage 26 and the second bearings 26 and 26A rest against the first plane bearing surfaces 31 and 31A, thereby preventing these bearings from moving in the direction 40 shown in FIG. 2.

During operation, as shown in FIGS. 2 and 3, the springs 17 and 34 relax. The four first bearings 25 and 25A then rest against the running surfaces 30 and 30A, and the second bearings 26 and 26A rest against the sloping bearing surfaces 33 and 33A.

On tripping, i.e. when passing from one position to the other, the coil 121 is powered and the latching member 120 is released.

The first spring 17 begins to relax driving the rod 10 in the direction of arrow 40. Without any thrust from the second spring 34, the bearings 25, 25A, 26, and 26A pass from their first position as shown in FIG. 1 to their second position as shown in FIG. 2. The second bearings 26 and 26A now have a portion of their outside surfaces resting against the sloping bearing surfaces 33 and 33A and thus transmit thrust from the second spring 34 to the first rod 10.

The thrust from these second bearings 26 and 26A on the bearing surfaces of the end piece 12 impede the initial motion of the rod 10 very little since the first bearings 25 and 25A move over the surfaces 30 and 30A.

The device of the invention thus has the major advantage of enabling additional mechanical energy due to the second spring 34 to be stored without said additional energy having any effect on latching. In the set position, only the first spring 17 bears against the latch, while the second spring 34 is locked by the bearing system.

The invention thus makes it possible to simplify the mechanical control of such a device; since the thrust due to the first spring is relatively low, latching is simplified and may be direct, thus avoiding stages which step down the stored energy. In addition, a very great deal of energy may be stored.

The device of the invention may be used for providing mechanically controlled cocking and tripping functions.

Naturally the present invention has been described and shown solely by way of preferred example and its component parts could be replaced by equivalent parts without thereby

What is claimed is: going beyond the scope of the invention.

1. A zero latching force energy storage device comprising a first rod sliding along an axis X and subjected to axial thrust from a first spring, said rod being fixed at a first end to electromagnetic controlled latching means and being coupled at a second end to energy storage means, the latching means comprising a rod provided with a transverse bore which, in the set position, rceives a latching member controlled by an electromagnet, wherein the energy storage means include a second rod slidable along the same axis X and subjected to axial force from a second spring, with the free end of the second rod facing the free end of the first rod and being connected to means for coupling it to said first rod and for locking it when the latching member is in a set position, wherein the coupling and locking means comprise at least one arm provided at a first end with at least one bearing having an axis of rotation perpendicular to the axis X, said arm being movable at a second end about an axis extending parallel to the axis of rotation of each bearing and fixed to the free end of the second rod, together with a fixed cage provided with at least one running surface extending parallel to th direction of the axis and to the axes of each bearing, said fixed cage terminating in an at least a partially flared portion facing the second rod, and the first rod terminating at its second end in an end piece provided with at least a first plane bearing surface parallel to the running surface and having a tapering free end; whereby each bearing, when the latching member is in the set position, is contained between said first plane bearing surface and the flared portion of the cage in such a manner as to lock the second spring.

2. A device according to claim 1, wherein the end piece of the first rod includes a second plane bearing surface parallel to the first plane bearing surface and separated from the first plane bearing surface by a third bearing surface which slopes towards the axis X.

3. A device according to claim 1, wherein each arm is provided at its end with at least one first bearing which runs over the running surface and with a second bearing capable of running over the bearing surfaces of the end piece of the first rod.

4. A device according to claim 3, wherein pairs of first bearings are disposed on either side of smaller diameter second bearings.

5. A device according to claim 1, wherein the second rod terminates in two hinged arms whose axes of rotation are situated symmetrically about the axis X, and in that the cage and the end piece are respective symmetrical structures about the axis X.

6. A device according to claim 1, wherein the cage is closed at its end facing the first rod by a cover having a bore passing there-through and centered on the axis X, with said first rod being slidable in said bore.

7. A device according to claim 6, wherein the first spring is a coil spring disposed around the first rod between a collar carried by the first rod and extending perpendicularly thereto, and the cover of the cage.

8. A device according to claim 1, wherein the second spring is a coil spring disposed around the second rod between a collar carried by the free end thereof and a fixed frame provided with a bore through which said rod slides.

* * * * *